US008966848B2

(12) United States Patent
Precht

(10) Patent No.: US 8,966,848 B2
(45) Date of Patent: Mar. 3, 2015

(54) SUN LOUVRE FORMED BY A STRUCTURE SUPPORTING AN INTERWEAVE OF METAL SHEETS

(71) Applicant: Patricio Mardones Precht, Santiago (CL)

(72) Inventor: Patricio Mardones Precht, Santiago (CL)

(73) Assignee: Hunter Douglas Chile S.A., San Bernardo (CL)

( * ) Notice: Subject to any disclaimer, the term of this patent is extended or adjusted under 35 U.S.C. 154(b) by 0 days.

(21) Appl. No.: 13/958,342

(22) Filed: Aug. 2, 2013

(65) Prior Publication Data

US 2014/0069052 A1 Mar. 13, 2014

(30) Foreign Application Priority Data

Aug. 3, 2012 (CL) ..... 2171-2012

(51) Int. Cl.
*E04F 13/07* (2006.01)
*E04F 13/08* (2006.01)
*E04F 13/00* (2006.01)

(52) U.S. Cl.
CPC ..... *E04F 13/0801* (2013.01); *E04F 13/07* (2013.01); *E04F 13/005* (2013.01)
USPC ..... 52/473; 52/78; 52/73

(58) Field of Classification Search
CPC ..... E04F 13/0801; E04F 13/07
USPC ..... 52/473, 73, 74, 78, 202
See application file for complete search history.

(56) References Cited

U.S. PATENT DOCUMENTS

| | | | | | |
|---|---|---|---|---|---|
| 326,371 | A | * | 9/1885 | Wilson | 52/473 |
| 2,145,073 | A | * | 1/1939 | Drake | 52/675 |
| 2,442,891 | A | * | 6/1948 | Harrison et al. | 52/75 |
| 2,797,451 | A | * | 7/1957 | Brown | 52/78 |
| 3,045,976 | A | | 7/1962 | Nayhouse et al. | |
| 3,378,955 | A | * | 4/1968 | Wahlgren | 49/397 |
| 3,507,079 | A | * | 4/1970 | George | 52/74 |
| 3,799,506 | A | | 3/1974 | Schwartz | |
| 4,126,926 | A | | 11/1978 | D'Amico | |
| 4,448,005 | A | * | 5/1984 | Vochelli | 52/473 |
| 4,726,153 | A | * | 2/1988 | Adler et al. | 52/63 |
| 6,202,363 | B1 | * | 3/2001 | Chang | 52/75 |

(Continued)

FOREIGN PATENT DOCUMENTS

| | | |
|---|---|---|
| BR | PI10027599 A2 | 7/2013 |
| CL | 1438-09 | 2/2012 |

(Continued)

OTHER PUBLICATIONS

Chilean Search Report dated Jan. 16, 2013 for Chilean Patent Application No. 1438-09, 7 pages.

*Primary Examiner* — Phi A
(74) *Attorney, Agent, or Firm* — Dorsey & Whitney LLP

(57) ABSTRACT

A sun louvre formed by a structure supporting an interweave of metal sheets is provided. The sun louvre includes a plurality of structural profiles and a plurality of supporting plates. The supporting plates have two perforations which are passed through by an outer tube and an inner tube. The sheets pass by a front portion of the outer tube and by a rear portion of the inner tube immediately precedent or previous with respect to the outer tube. Adjacent sheets are interwoven in an alternate manner with respect to the outer and inner tubes. Ends of the sheets have reinforcement plates from which a hook is gripped. The hook has a stud fixed thereto that is enclosed by a spring that tensions the sheets.

20 Claims, 4 Drawing Sheets

(56) References Cited

U.S. PATENT DOCUMENTS

| | | | | |
|---|---|---|---|---|
| 8,117,794 | B2 * | 2/2012 | Wang Chen | 52/592.1 |
| 8,312,684 | B2 * | 11/2012 | Gazaway et al. | 52/473 |
| 8,365,492 | B2 * | 2/2013 | Frest et al. | 52/473 |
| 8,528,578 | B2 * | 9/2013 | Mowatt, Sr. | 135/88.12 |
| 2002/0002800 | A1 * | 1/2002 | Schmitz | 52/74 |
| 2004/0031233 | A1 * | 2/2004 | Cope et al. | 52/769 |
| 2005/0246983 | A1 | 11/2005 | Loyd | |

FOREIGN PATENT DOCUMENTS

| | | | |
|---|---|---|---|
| CN | 101565996 | A | 10/2009 |
| DE | 19518639 | C1 | 7/1996 |
| DE | 19606422 | A1 | 7/1996 |
| DE | 20312122 | U1 | 12/2003 |
| DE | 202004018679 | U1 | 2/2005 |
| DE | 102004004763 | A1 | 8/2005 |
| DE | 102005002635 | A1 | 8/2006 |
| EP | 1233118 | A2 | 8/2002 |
| ES | 1063739 | U | 12/2006 |
| FR | 2563262 | A1 | 10/1985 |
| JP | 2001003529 | A | 1/2001 |
| JP | 2002054283 | A | 2/2002 |
| JP | 2003193659 | A | 7/2003 |
| JP | 2004092157 | A | 3/2004 |
| KR | 20060112214 | A | 10/2006 |
| WO | 93/12307 | A1 | 6/1993 |
| WO | 2007/051541 | A1 | 5/2007 |
| WO | 2008046522 | A1 | 4/2008 |

* cited by examiner

SUN LOUVRE FORMED BY A STRUCTURE SUPPORTING AN INTERWEAVE OF METAL SHEETS

CROSS-REFERENCE TO RELATED APPLICATION

This application claims priority under 35 U.S.C. 119(a)-(d) and 35 U.S.C. 365 pursuant to the Paris Convention for the Protection of Industrial Property to Chilean Utility Model Patent Application No. 2171-2012, filed on Aug. 3, 2013, and entitled "A Sun Louvre (1) Formed by a Structure Supporting an Interweave of Metal Sheets Which Allows For an Easy Installation (Stripweave XL)", which is hereby incorporated in its entirety by reference as though fully disclosed herein.

TECHNICAL FIELD

The present disclosure relates to a sun louvre formed by a structure supporting an interweave of metal sheets.

BACKGROUND

There are several types of metal sun louvres for facades having interwoven strips, however, generally they are difficult to install, therefore a much more simple solution is sought which can also minimize installation time.

In the state of art we can find a variety of sun louvres, such as for example, document WO 2007/051541 which relates to a building façade lining with the aid of metal panels placed side by side. The system comprises rails fixed to the façade and thin metal coverings panels which are placed side by side in a parallel position thereto, wherein each panel is provided with fixing elements which are arranged on the façade faces of the panels, connected by non-through means thereto and are used for interacting with said rails, in that said interaction defines a single fixing point for each panel devoid of a degree of freedom and the sliding fixing points allow the degrees of freedom required for the free heat expansion of said panel.

Document EP 1233118 (Giesenkamper et al.) It discloses a facade cladding which has been fixed in a detachable manner on a support structure secured to a building wall and which comprises cladding cassettes configured in a rectangular manner with parallel longitudinal sides and transverse sides, as well as front faces arranged in a spaced manner from the building wall, having angled the longitudinal and transverse sides from the front faces towards the building wall, wherein the cladding cassettes are supported by rectangular lower cassettes fixed to the structure and the longitudinal sides of the cladding cassettes being gripped, adjacent to the longitudinal sides of the lower cassettes, to the longitudinal sides of the lower cassettes.

Document FR 2563262 discloses an assembly for building facades cladding. This cladding comprises a set formed by rectangular metal panels comprising at their ends longitudinal folds enabling them to be fastened onto facing lugs which are firmly fixed to the said uprights so as when these panels are laid horizontally, they have the appearance of being an ornamental aspect of the construction. These claddings are used on building facades in order to waterproof said facades.

Document ES 1063739 discloses a perforated or expanded metal tray for ventilated facade, which is metallic, made of a punched, pressed, expanded, perforated plate or by a combination of some or several of said processes and subsequently folded or profiled, characterized in that it is total or partially perforated, shaped as a longitudinal U open on its ends, placed with its base on upright position and fixed to a support structure and being longitudinally provided on the edges of both wings, either perpendicular or not to its base, with a series of folds with the perforated faces and which joint by means of fitting with the wings of adjacent trays, allows for the successively configuration of some horizontal resistant ribs which can be in the shape of rectangular, trapezoidal, triangular section, open or close and that, when being perforated allow for the passage of air from a tray to the following throughout the whole facade, thus forming a self-ventilated facade in conjunction with the cladding plates of the facade which will rest on said ribs.

None of the previous art documents show a sun louvre formed by a structure supporting an easy-to install interweave of metal sheets.

BRIEF DESCRIPTION OF FIGURES

The enclosed figures are included in order to provide a better understanding of the disclosure as well of some of the preferred embodiments and also to explain the principles of this disclosure.

DESCRIPTION OF THE INVENTION

The present disclosure relates to a sun louvre formed by a structure supporting an interweave of metal sheets.

Figure 2:
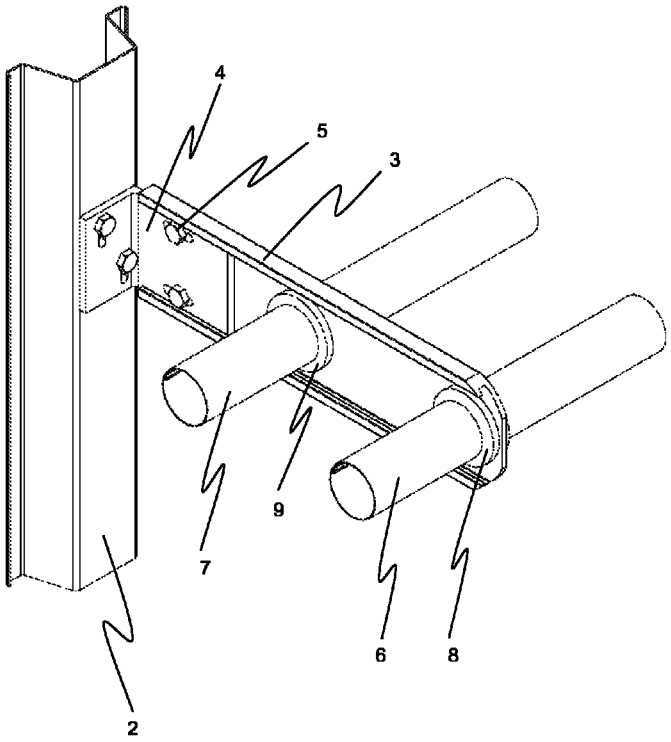
FIG. 2 shows a perspective view of the fixation system of double tubes used in the sun louvre structure of the present disclosure.

The sun louvre (1) is formed by a plurality of structural profiles (2) which are elongated and vertically placed in a spaced manner side by side, to which on the upper part a plurality of supporting plates (3) are attached in a spaced manner one on top of the other, using for the connection between the structural profiles (2) and supporting plates (3) brackets (4) with screws (5). The supporting plates (3) have two perforations which are passed through by an outer tube (6) and by an inner tube (7) which are fixed to each one of the supporting plates (3), by means of an outer fixing ring (8) and an inner fixing ring (9) as illustrated in FIG. 2.

Figure 1:
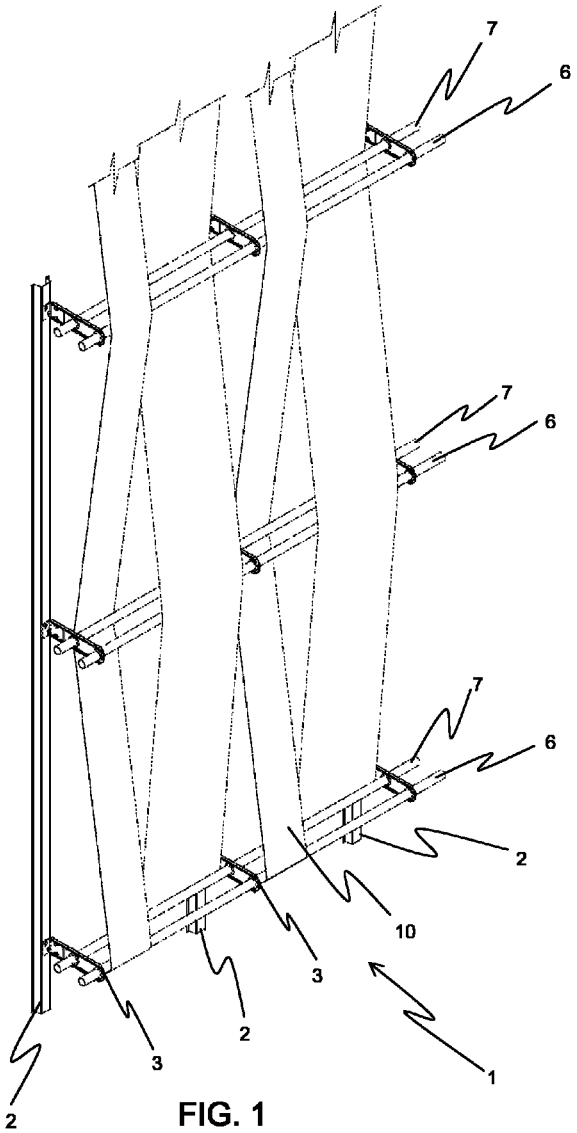
FIG. 1 shows a perspective view of the sun louvre of the present disclosure.

The metal strips along with the sheets (10) pass through the front portion of the outer tube (6) and the rear portion of the inner tube (7) immediately preceding or previous with respect to the outer tube (6) thus following up to the ends of the sun louvre (1). An adjacent strip with the adjacent sheets (10) are interwoven in an alternate way relative to the outer and inner tubes (6, 7) as shown in FIG. 1.

Figure 3:
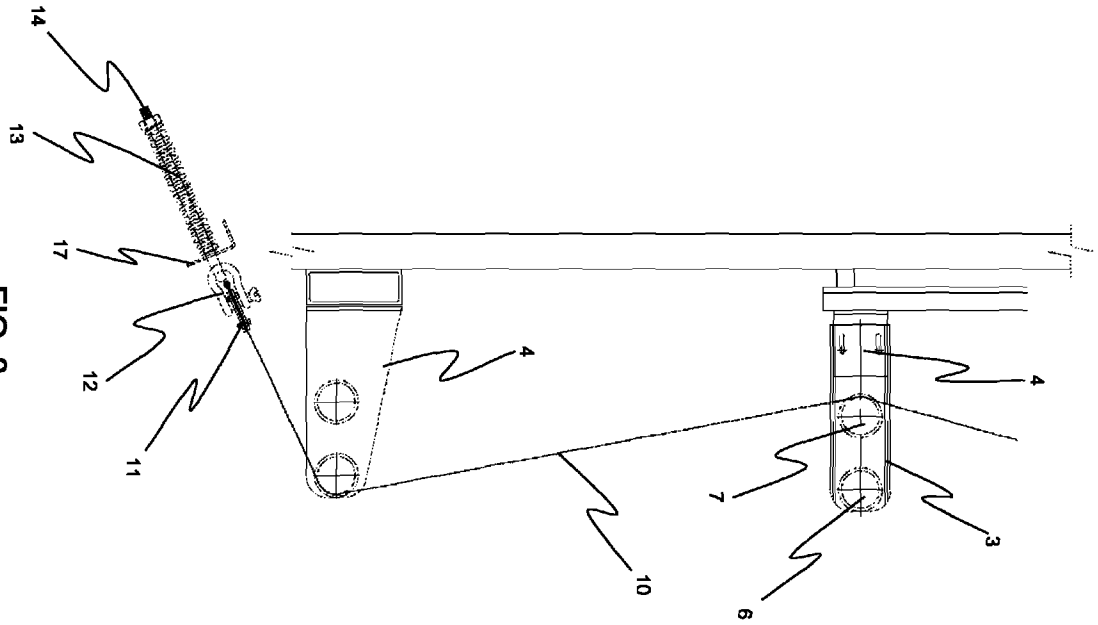
FIG. 3 shows a side view of the tensioning system of the metal sheets used in the sun louvre of the present disclosure.
Figure 4:
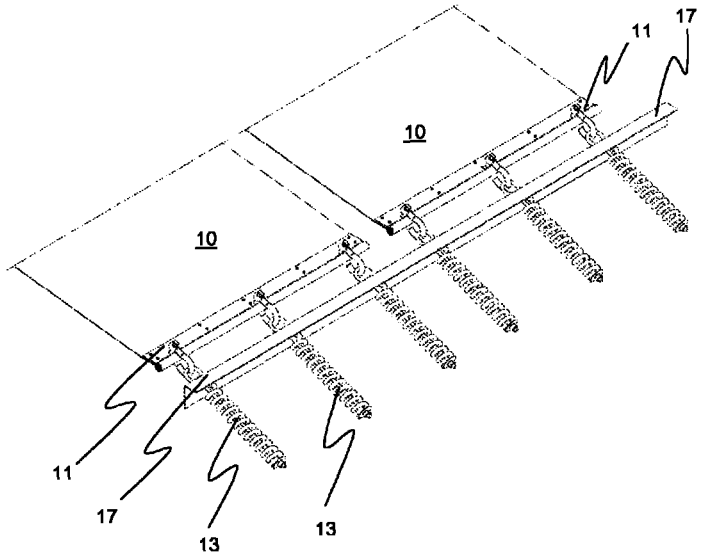
FIG. 4 shows a perspective view of the plurality of springs used by the tensioning system of the sun louvre of the present disclosure.
Figure 5:
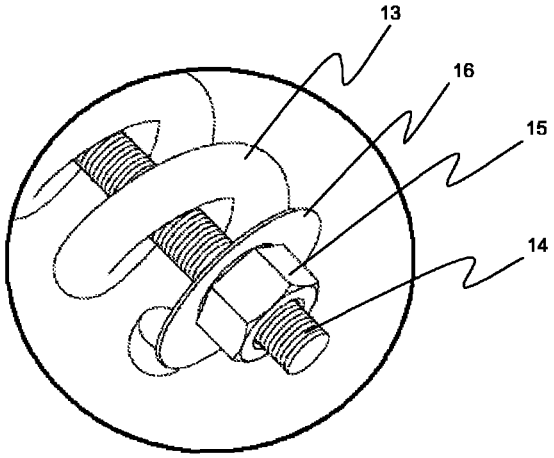
FIG. 5 shows an enlarged perspective view of the spring and tension stud used in the sun louvre of the present disclosure.

According to FIGS. 3, 4 and 5, the ends of sheets (10) have reinforcement plates (11) from which a hook (12) is gripped which has a stud (14) fixed thereto, said stud (14) being anchored to the building wall where the sun louvre (1) is to be installed. This stud (14) is enclosed by a spring (13) which provides the sheets (10) with the tension by tightening a nut (15) along with its respective washer (16). This tightening is made towards a restraint cross section profile (17) attached to the stud (14) and which retains the spring (13).

What is claimed is:

1. A sun louvre formed by a structure supporting an interweave of metal sheets which allows for an easy installation, the sun louvre comprising:

a plurality of structural profiles that are elongated and vertically placed in a spaced manner side by side, to which a plurality of supporting plates are attached in a spaced manner, wherein the plurality of supporting plates each have two perforations passed through by an outer tube and by an inner tube, the outer and inner tubes fixed to the plurality of supporting plates by outer and inner fixing rings;

a plurality of metal sheets passing by a front portion of one or more outer tubes and by a rear portion of one or more inner tubes immediately previous the one or more outer tubes, wherein adjacent sheets are interwoven in an alternate way relative to the outer and inner tubes;

wherein ends of the plurality of sheets each have a reinforcement plate from which a hook is gripped, the hook having a stud fixed thereto that is enclosed by a spring that provides a respective sheet with tension by tightening a nut along with its respective washer toward a restraint cross section profile attached to the stud.

2. A sun louvre comprising:

a plurality of elongated, structural profiles placed side-by-side in a spaced manner;

a plurality of tubes attached and extending transversely to the plurality of elongated, structural profiles;

a plurality of sheets interwoven through the plurality of tubes, wherein immediately adjacent sheets are interwoven in an alternate way relative to the tubes;

a plurality of externally-threaded studs attached to ends of the plurality of sheets;

a restraint cross section profile attached and extending transversely to the plurality of externally-threaded studs;

a plurality of fasteners threadedly engaged with the plurality of externally-threaded studs; and a plurality of springs positioned about the plurality of studs between the restraint cross section profile and the plurality of fasteners, wherein tightening the plurality of fasteners towards the restraint cross section profile tensions the plurality of sheets.

3. The sun louvre of claim 2 further comprising a plurality of reinforcement plates attached to the ends of the plurality of sheets.

4. The sun louvre of claim 3 further comprising a plurality of hooks attached to the plurality of reinforcement plates, wherein the plurality of externally-threaded studs are attached to the plurality of hooks.

5. The sun louvre of claim 2 further comprising a plurality of supporting plates attached to the plurality of elongated, structural profiles.

6. The sun louvre of claim 5 wherein each supporting plate of the plurality of supporting plates defines two perforations that receive a pair of tubes of the plurality of tubes.

7. The sun louvre of claim 6 wherein the pair of tubes includes an outer tube and an inner tube.

8. The sun louvre of claim 7 wherein the outer tube is attached to a respective supporting plate by a first fixing ring, and wherein the inner tube is attached to the respective supporting plate by a second fixing ring.

9. The sun louvre of claim 7 wherein one or more sheets of the plurality of sheets pass by a front portion of a respective outer tube and pass by a rear portion of a respective inner tube that is immediately preceding the respective outer tube.

10. The sun louvre of claim 5 wherein the plurality of supporting plates are attached to the plurality of elongated, structural profiles by a plurality of brackets.

11. The sun louvre of claim 1 wherein the plurality of supporting plates are attached to the plurality of elongated, structural profiles by a plurality of brackets.

12. The sun louvre of claim 1 wherein the spring is retained between the respective washer and the restraint cross section profile.

13. A sun louvre comprising:

a plurality of elongated, structural members placed side-by-side in a spaced manner;

a plurality of tubes attached and extending transversely to the plurality of elongated, structural members;

a plurality of sheets interwoven through the plurality of tubes, wherein immediately adjacent sheets are interwoven in an alternate way relative to the tubes;

a plurality of externally-threaded studs attached to ends of the plurality of sheets;

a plurality of fasteners threadedly engaged with the plurality of externally-threaded studs; and a plurality of springs positioned about and retained on the plurality of externally-threaded studs, wherein threading the plurality of fasteners along the plurality of externally-threaded studs tensions the plurality of sheets.

14. The sun louvre of claim 13 further comprising a restraint cross section profile attached and extending transversely to the plurality of externally-threaded studs.

15. The sun louvre of claim 14 wherein the plurality of springs is retained on the plurality of externally-threaded studs between the restraint cross section profile and the plurality of fasteners.

16. The sun louvre of claim 15 wherein tightening the plurality of fasteners towards the restraint cross section profile tensions the plurality of sheets.

17. The sun louvre of claim 13 further comprising a plurality of reinforcement plates attached to the ends of the plurality of sheets.

18. The sun louvre of claim 17 further comprising a plurality of hooks attached to the plurality of reinforcement plates, wherein the plurality of externally-threaded studs are attached to the plurality of hooks.

19. The sun louvre of claim 13 further comprising a plurality of supporting plates attached to the plurality of elongated, structural members.

20. The sun louvre of claim 19 wherein each supporting plate of the plurality of supporting plates defines two perforations that receive a pair of tubes of the plurality of tubes.

* * * * *